252-99 AU 166 EX
2/26/80 US 4,190,551

United States Patent [19]
Murata et al.
[11] 4,190,551
[45] Feb. 26, 1980

[54] GRANULAR OR POWDERY DETERGENT COMPOSITION OF HIGH FLUIDITY

[75] Inventors: Moriyasu Murata; Fumio Sai, both of Chiba, Japan

[73] Assignee: Kao Soap Co., Ltd., Tokyo, Japan

[21] Appl. No.: 913,221

[22] Filed: Jun. 6, 1978

[30] Foreign Application Priority Data

Jun. 14, 1977 [JP] Japan ..... 52/70358

[51] Int. Cl.[2] ..... C11D 1/72; C11D 7/02; C11D 17/06

[52] U.S. Cl. ..... 252/99; 252/174.25; 252/135; 252/528; 252/529; 252/547; 252/548; 252/539; 252/558

[58] Field of Search ..... 252/89, 99, 132, 135, 252/539, 558, 548, 547, 528, 529; 423/429

[56] References Cited

U.S. PATENT DOCUMENTS

| | | | |
|---|---|---|---|
| 3,849,327 | 11/1974 | Di Salvo et al. | 252/109 |
| 3,915,878 | 10/1975 | Yurko et al. | 252/89 |
| 4,056,355 | 11/1977 | Kolaian et al. | 8/137 |
| 4,064,063 | 12/1977 | Alder et al. | 252/135 |
| 4,071,377 | 1/1978 | Schwuger et al. | 134/29 |
| 4,073,867 | 2/1978 | Roebke et al. | 423/429 |
| 4,083,793 | 4/1978 | Jakobi et al. | 252/99 |
| 4,092,261 | 5/1978 | Sperling et al. | 252/131 |

FOREIGN PATENT DOCUMENTS 2538679 12/1976 Fed. Rep. of Germany .

OTHER PUBLICATIONS

Breck, D. W., "Zeolite Molecular Sieves," John Wiley and Sons, N.Y., copyright 1974, pp. 322–328.

*Primary Examiner*—P. E. Willis, Jr.
*Attorney, Agent, or Firm*—Blanchard, Flynn, Thiel, Boutell & Tanis

[57] ABSTRACT

A granular or powdery detergent composition comprises a nonionic surface active agent adsorption mixture composed of a nonionic surface active agent and a water-insoluble, amorphous, phosphorus-containing alkali metal aluminosilicate of the formula (I):

$$X(M_2O)\cdot Al_2O_3\cdot Y(SiO_2)\cdot Z(P_2O_5)\cdot \omega(H_2O) \quad (I)$$

wherein M stands for Na or K, and X, Y, Z and $\omega$ are mole numbers of the respective components satisfying the following requirements:
$0.20 \leqq X \leqq 1.10$, $0.20 \leqq Y \leqq 4.00$, and
$0.001 \leqq Z \leqq 0.80$,
$\omega$ being an optional positive number inclusive of 0.

24 Claims, No Drawings

GRANULAR OR POWDERY DETERGENT COMPOSITION OF HIGH FLUIDITY

BACKGROUND OF THE INVENTION

1. FIELD OF THE INVENTION

The present invention relates to a granular or powdery detergent composition containing a non-ionic surface active agent. More particularly, the invention relates to a granular or powdery detergent composition comprising a non-ionic surface active agent adsorbed on a water-insoluble adsorption member. More specifically, the present invention relates to a granular or powdery detergent composition having a good flowability, which comprises an amorphous, phosphorus-containing alkali metal aluminosilicate on which a non-ionic surface active agent is adsorbed. By the term "good flow-ability" used herein is meant such a property that the granular or powdery detergent composition keeps a dry non-sticky state for a long time and cohesion or caking is not caused.

2. DESCRIPTION OF PRIOR ARTS

Most non-ionic surface active agents suitable for detergents are in the form of liquids or viscous solids at normal temperatures, and they can hardly be incorporated in granular or powdery detergent compositions as they are. As the method for incorporation of such non-ionic surface active agent in a detergent, there can be mentioned (1) a method in which a non-ionic surface agent is incorporated in a slurry of a detergent and the mixture is spray-dried, (2) a method in which a non-ionic surface active agent is adsorbed on a specific substance and the adsorption mixture is incorporated into a powdery detergent, and (3) a method in which a detergent base free of a non-ionic surface active agent is formed by spray drying and a non-ionic surface active agent is sprayed onto the detergent base to cause it to adhere to the detergent base.

According to the spray-drying method (1), however, a part of the non-ionic surface active agent is lost by contact with hot air in the drying column and is discharged with the exhaust gas, and therefore, generation of a bad smell or environmental pollution is caused. According to the spray-adhering method (3), the surface active agent can be included only in a small amount such as several percent. Therefore, at the present, there is mainly adopted a method in which a liquid or viscous solid non-ionic surface active agent is adsorbed on a specific substance to form a powdery detergent composition having a good flowability. As this specific substance (adsorbent), there are known finely divided inorganic substances such as talc, finely divided silica, clay and calcium silicate. However, these inorganic substance powders have, in general, no particular property other than the property of adsorbing a non-ionic surface active agent and providing a powder having a good flowability, and they have no positive effect of improving the washing capacity. Further, such inorganic powder should be incorporated in a large quantity in order for the non-ionic surface active agent to exert a sufficient washing power, and therefore, such inorganic powder fails to satisfy industrial requirements sufficiently. It has been attempted to adsorb a non-ionic surface active agent on builders customarily incorporated into powdery detergents, such as sodium tripolyphosphate, sodium perborate, sodium sulfate, sodium carbonate and the like. Also in this case, if the amount of the non-ionic surface active agent exceeds 10% by weight, cohesion or caking is readily caused and a composition having a sufficient flowability cannot be obtained. Recently, there has been proposed a process (see Japanese Patent Application Laid-Open Specification No. 119813/75) in which a non-ionic surface active agent is adsorbed on a alkali metal or alkaline earth metal aluminosilicate recently proposed as a water-insoluble builder (see Japanese Patent Application Laid-Open Specifications Nos. 12381/75, 21009/75, 53404/75 and 37104/75 and West Germany Patent Application Laid-Open Specification No. 2,538,679), and the mixture is then granulated and incorporated in a detergent. As a result of our researches, it has been found that even if non-ionic surface active agents are adsorbed on these aluminosilicates, it is difficult to obtain powders having a good flowability. Under such background, it has been eagerly desired to develop a non-ionic surface active agent adsobent which is capable of adsorbing a non-ionic surface active agent at a high concentration and keeping a good flowability, and having a washing effect at the same time.

SUMMARY OF THE INVENTION

As a result of our researches made with a view to developing such non-ionic surface active agent adsorbent, it was found that a specific adsorbent can adsorb a non-ionic surface active agent at a high concentration while keeping a good flowability and it has a high divalent metal ion-sequestering property and a high washing effect. Based on this finding, we have now completed the present invention.

More specifically, in accordance with the present invention, there is provided granular or powdery detergent composition comprising a non-ionic surface active agent adsorption mixture composed of a non-ionic surface active agent adsorbed on a water-insoluble, amorphous, phosphorus-containing alkali metal aluminosilicate represented by the following general formula (I):

$$X(M_2O).Al_2O_3.Y(SiO_2).Z(P_2O_5).\omega(H_2O) \quad (I)$$

wherein M stands for Na or K, and X, Y, Z and $\omega$ are mole numbers of the respective components satisfying the following requirements:

$0.20 \leqq X \leqq 1.10$, $0.20 \leqq Y \leqq 4.00$, and $0.001 \leqq Z \leqq 0.80$, preferably $0.01 \leqq Z \leqq 0.55$, $\omega$ being an optional positive number inclusive of 0.

It is construed that the amorphous, phosphorus-containing alkali metal aluminosilicate of the above general formula (I), that is used in the present invention, has a structure in which a part of $[SiO_4]$ of the aluminosilicate is replaced by $[PO_4]$, and that introduction of $[PO_4]$ has some influence on the surface of the solid and exerts an effect of improving the non-ionic surface active agent-adsorbing property and divalent metal ion-sequestering property, although the mechanism has not yet been elucidated. The amorphous, phosphorus-containing alkali metal alumino-silicate of the present invention can be prepared, for example, by simultaneously adding an aqueous solution of an alkali metal silicate and an aqueous solution of an alkali metal phosphate to an aqueous solution of aluminum sulfate, agitating the mixture sufficiently, adding sodium hydroxide to the mixture and agitating the mixture at 90° to 100° C. for about 1.5 hours. The amorphous, phosphorus-containing alkali metal aluminosilicate is industrially advantageous also in the point that it can easily be synthesized according to a method as described above. It is preferred that each of the calcium ion-sequestering and magnesium ion-separating capacities of the amorphous, phosphorus-containing alkali metal aluminosilicate of the present invention represented by the general formula (I) be at least 100 mg, especially at least 150 mg, calculated as $CaCO_3$, per gram of the aluminosilicate. It also is preferred that the particle size of the aluminosilicate of the present invention be smaller than 100μ, particularly smaller than 50μ, especially particularly less than 10μ.

Any non-ionic surface active agents customarily used for ordinary detergent compositions can be used in the present invention, and the kind of the non-ionic surface active agent that is used in the present invention is not particularly limited. For example, the following non-ionic surface active agents may be used.

(A) Polyoxyethylene alkyl or alkenyl ethers having an alkyl or alkenyl group having 10 to 20 carbon atoms on the average and containing 1 to 20 moles of added ethylene oxide.

(B) Polyoxyethylene alkyl phenyl ethers having an alkyl group having 6 to 12 carbon atoms on the average and containing 1 to 20 moles of added ethylene oxide.

(C) Higher fatty acid alkanolamides or their alkylene oxide adducts, represented by the following general formula:

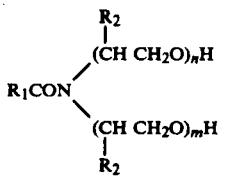

wherein $R_1$ stands for an alkyl or alkenyl group having 10 to 20 carbon atoms, $R_2$ stands for H or $CH_3$, n is an integer of from 1 to 3, and m is an integer of from 0 to 3.

(D) Sucrose fatty acid esters consisting of a fatty acid having 10 to 20 carbon atoms on the average and sucrose.

(E) Fatty acid glycerin monoesters consisting of a fatty acid having 10 to 20 carbon atoms on the average and glycerin.

(F) Alkylamine oxides represented by the following general formula:

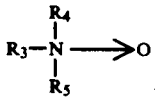

wherein $R_3$ stands for an alkyl or alkenyl group having 10 to 20 carbon atoms, and $R_4$ and $R_5$ each stand for an alkyl group having 1 to 3 carbon atoms.

The adsorption mixture of the present invention, composed of an amorphous, phosphorus-containing alkali metal aluminosilicate and a non-ionic surface active agent, contains 1 to 75% by weight, preferably 5 to 65% by weight, especially preferably 20 to 50% by weight, of the non-ionic surface active agent, though this content is changed to some extent depending on the particle size of the phosphorus-containing alkali metal aluminosilicate. The adsorption mixture may further comprise customary detergent components such as anionic surfactants, sodium tripolyphosphate, sodium sulfate and soda ash, and disintegrating agents such as starch, calcium carboxymethyl cellulose and alginic acid.

The adsorption mixture of the present invention, composed of an amorphous, phosphorus-containing alkali metal aluminosilicate and a non-ionic surface active agent, is prepared, for example, by spraying or mixing and agitating a liquid or heat-liquefied non-ionic surface active agent to or with an amorphous, phosphorus-containing alkali metal aluminosilicate.

The granular or powdery detergent composition of the present invention comprises 1 to 100% by weight of the above adsorption mixture composed of a non-ionic surface active agent adsorbed on an amorphous, phosphorus-containing alkali metal aluminosilicate. Namely, the adsorption mixture may be used as a detergent by itself, or it may be incorporated in a powdery detergent formed by conventional spray-drying. In the latter case, the adsorption mixture is incorporated in an amount of 5 to 75% by weight, preferably 10 to 50% by weight.

The detergent composition of the present invention may comprise, in addition to the above-mentioned adsorption mixture, 1 to 50% by weight, preferably 5 to 40% by weight, of at least one member selected from various anionic surface active agents and amphoteric surface active agents such as described below. In case of anionic surface active agents, as the counter ion, there can be mentioned, for example, alkali metal ions such as sodium and potassium, alkaline earth metal ions such as calcium and magnesium, an ammonium ion, and salts of alkanolamines having 1 to 3 alkanol groups having 2 to 3 carbon atoms, such as monoethanolamine and diethanol amine, (1) Straight or branched alkylbenzene-sulfonic acid salts having an alkyl group having 10 to 16 carbon atoms on the average.
(2) Alkyl or alkenyl ethoxy-sulfuric acid salts having a straight or branched alkyl or alkenyl group having 10 to 20 carbon atoms on the average and containing 0.5 to 8 moles of added ethylene oxide in one molecule.
(3) Alkyl or alkenyl sulfuric acid salts having an alkyl or alkenyl group having 10 to 20 carbon atoms on the average.
(4) Olefin-sulfonic acid salts having 10 to 20 carbon atoms on the average in one molecule.
(5) Alkane-sulfonic acid salts having 10 to 20 carbon atoms on the average in one molcule.
(6) Saturated or unsaturated fatty acid salts having 10 to 20 carbon atoms on the average in one molecule.
(7) Alkyl or alkenyl ethoxy-carboxylic acid salts having an alkyl or alkenyl group having 10 to 20 carbon atoms on the average and containing 0.5 to 8 moles of added ethylene oxide in one molecule.
(8) α-Sulfo-fatty acid salts or esters represented by the following formula:

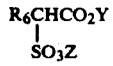

wherein Y stands for an alkyl group having 1 to 3 carbon atoms or a counter ion as mentioned above, Z stands for a counter ion as mentioned above, and $R_6$ stands for an alkyl or alkenyl group having 10 to 20 carbon atoms.

(9) Amphoteric surface active agents represented by the following formula:

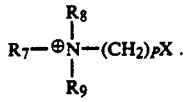

wherein $R_7$ stands for an alkyl or alkenyl group having 10 to 20 carbon atoms, $R_8$ and $R_9$ each stand for an alkyl group having 1 to 4 carbon atoms, p designates an integer of from 1 to 3, and X stands for a group $—COO^-$ or $—SO_3^+$.

The detergent composition of the present invention may comprise, in addition to the above-mentioned adsorption mixture, 0 to 50% by weight of at least one builder selected from alkali metal salts of condensed phosphoric acids such as tripolyphosphoric acid, pyrophosphoric acid and metaphosphoric acid, aminopolyacetic acids such as nitrilotriacetic acid, ethylenediamine-tetraacetic acid and diethylenetriamine-pentaacetic acid, hydroxycarboxylic acids such as citric acid, malic acid and glycolic acid, and polymeric electrolytes such as an alkali-hydrolyzed vinyl acetate/maleic anhydride copolymer.

Still in addition, the detergent composition of the present invention may comprise as an alkaline agent or inorganic electrolyte 1 to 50% by weight, preferably 5 to 30% by weight, of at least one member selected from alkali metal silicates, alkali metal carbonates and alkali metal sulfates.

Furthermore, the detergent composition of the present invention may comprise 0.1 to 5% by weight of at least one compound selected from polyethylene glycol, polyvinyl alcohol, polyvinyl pyrrolidone and carboxymethyl cellulose as the anti-redeposition agent.

A bleaching agent such as sodium percarbonate, sodium perborate, sodium sulfate-hydrogen peroxide adduct, sodium chloride-hydrogen peroxide adduct or the like, a whitening agent such as a commercially available fluorescent dye, and other additive such as a perfume, an enzyme or a bluing agent may be incorporated in the detergent composition of the present invention according to need.

The present invention will now be described in detail by reference to the following Examples that by no means limit the scope of the invention.

EXAMPLE 1

(1) Synthesis of Amorphous, Phosphorus-Containing Aluminosilicate:

Aqueous solutions A and B having the following composition were prepared.

A. A solution formed by dissolving 16.3 g of aluminum sulfate $[Al_2(SO_4)_3.16-18H_2O]$ in 75 ml in deionized water.

B. A solution formed by dissolving 12.2 g of sodium silicate $[Na_2SiO_3.9H_2O]$ and 9.5 g of sodium phosphate $[Na_3PO_4.12H_2O]$ in 50 ml of deionized water.

The aqueous solution B was added to the aqueous solution B and the mixture was sufficiently agitated at room temperature. Then, a solution of 2.5 g of sodium hydroxide in 50 ml of deionized water was added to the mixture, and the mixture was agitated at 95° C. to advance reaction. After the reaction had been continued for 1.5 hours, the reaction product was taken out, washed sufficiently with deionized water and dried at 105° C.

According to the X-ray diffraction measurement, it was found that the reaction product was an amorphous solid. According to the chemical analysis, the reaction product (P-1) had a composition of $0.63(Na_2O).Al_2O_3.1.92(SiO_2).0.19(P_2O_5).6H_2O$.

(2) Polyvalent Metal Ion-Sequestering Capacity (sequestration capacity of heavy metal ion; hereinafter referred to as "SC"):

(2-1) Measurement Method:

To 200 ml of magnesium chloride- or calcium chloride-containing hard water (500 ppm as calculated as calcium carbonate) was added 0.2 g of a sample, and the mixture was agitated from 15 minutes at room temperature while maintaining the pH at 10 (by addition of NaOH or HCl) and was then filtered. The hardness ($H_1$) of water before addition of the sample and the hardness ($H_2$) of the filtrate were determined according to the EDTA titration method. The polyvalent metal ion-sequestering capacity (SC) was calculated according to the following formula:

$$SC = \frac{H_1 - H_2}{\text{weight (g) of sample in 1 liter}}$$

(2-21) Results:

The calcium ion—and magnesium ion-sequestering capacities of (P-1) according to the present invention are shown in Table 1. For comparison, also the sequestering capacities of sodium tripolyphosphate and various aluminosilicates are shown in Table 1.

| | | S $Ca^{2+}$ (mg $CaCO_3$/g) | C $Mg^{2+}$ (mg $CaCO_3$/g) |
|---|---|---|---|
| 1 | Sodium tripolyphosphate (STPP) | 303 | — |
| 2 | $(Na_2O, K_2O) . (Al_2O_3) . 2.00(SiO_2) . 4.5H_2O$ | 253 | — |
| 3 | $(Na_2O) . (Al_2O_3) . 2.00(SiO_2) . 4.5H_2O$ | 280 | 75 |
| 4 | $(Na_2O) . (Al_2O_3) . 2.46(SiO_2) . 6.4H_2O$ | 221 | 170 |
| 5 | P-1* | 285 | 173 |

Note:
*: the present invention (3) Flowability of Adsorption Mixture:

Softanol $[C_{12-14}—O(CH_2CH_2O)_7H$ manufactured by Nippon Shokubai Kagaku] was adsorbed in an amount of 10 to 50% by weight (by "50% by weight" used herein is meant a mixture comprising 50 parts by weight of the aluminosilicate and 50 parts by weight of Softanol) on the amorphous, phosphorus-containing aluminosilicate of the present invention by spraying or mixing under agitation. The state of the resulting powder was examined and evaluated to obtain results shown in Table 2.

For comparison, known non-ionic surface active agent adsorbents were similarly tested, and obtained results are shown in Table 1.

Table 2

| Run No. | Adsorbent | State of Powder[1] Amount Adsorbed (% by weight) 10 | 20 | 30 | 50 |
|---|---|---|---|---|---|
| 6 | P-1* | o | o | o | o |
| 7 | P-2* | o | o | o | o |
| 8 | P-3* | o | o | o | o |
| 9 | P-4* | o | o | o | o |
| 10 | P-5* | o | o | o | o |
| 11 | finely divided silica | Δ | Δ | XX | XX |
| 12 | kaolite (clay) | Δ | Δ | X | XX |
| 13 | talc | Δ | Δ | X~XX | XX |
| 14 | sodium tripolyphosphate | Δ | X | XX | XX |
| 15 | clinoptilolite[2] | Δ | Δ | X~XX | XX |
| 16 | synthetic zeolite type A | Δ | Δ | Δ~XX | XX |
| 17 | Micro-cel E[3] | o | o | o | o |

Note:
[1]o: non-sticky dry powder
Δ: sticky powder
X: sticky mass
XX: pasty
*: product of the present invention
P-2: $0.33(Na_2O) \cdot (Al_2O_3) \cdot 0.37(SiO_2) \cdot 0.026(P_2O_5)3.25(H_2O)$
P-3: $0.65(Na_2O) \cdot (Al_2O_3) \cdot 1.15(SiO_2) \cdot 0.61(P_2O_5)3.56(H_2O)$
P-4: $0.90(Na_2O) \cdot (Al_2O_3) \cdot 1.60(SiO_2) \cdot 0.20(P_2O_5)4.00(H_2O)$
P-5: $1.03(Na_2O) \cdot (Al_2O_3) \cdot 3.12(SiO_2) \cdot 0.007(P_2O_5)4.92(H_2O)$
[2]natural zeolite
[3]calcium silicate manufactured by Johns-Manville, U.S.A.

EXAMPLE 2

Dobanol 45-5EO [$C_{14\cdot15}-O\leftarrow CH_2CH_2O\rightarrow_5H$ manufactured by Mitsubishi Yuka] was adsorbed on P-1, P-2, P-3, P-4 and P-5 in an amount of 75% by weight by spraying or mixing under agitation. In each case, a non-ionic surface active agent adsorption mixture in the form of a non-sticky dry powder.

EXAMPLE 3

Emulgen 108 [$C_{12}-O\leftarrow CH_2CH_2O\rightarrow_8H$ manufactured by Kao-Atlas] was adsorbed in an amount of 10% by weight on a mixture having the following composition by spraying or mixing under agitation to obtain a detergent composition in the form of a non-sticky dry powder. Composition:

| | |
|---|---|
| Sodium linear-dodecyl benzene-sulfonate | 15% |
| Sodium tripolyphosphate | 20% |
| Soda ash | 10% |
| Sodium Sulfate | 35% |
| P-1 | 20% |

EXAMPLE 4

Oxocohole 7EO [$C_{12\cdot13}-O\leftarrow CH_2CH_2O\rightarrow_7H$ manufactured by Nissan Kagaku] was adsorbed in an amount of 50% by weight on P-1 of the present invention and the resulting adsorption mixture was homogeneously incorporated in an amount of 5 to 30% by weight into an ordinary powdery detergent formed by spray drying. The flowability and other properties of the resulting detergent composition were tested to obtain results shown in Table 3.

(1) Measurement Method:

The flowability was determined by using an apparent density measuring tester according to the synthetic detergent method JIS K-3362. More specifically, about 100 cc of the powdery detergent was permitted to freely fall down into a 100-cc beaker located on the lower end from a density measuring tester and the quantity of the detergent was precisely measured. Then, the measured detergent was charged in a funnel portion of the apparent density measuring tester and a damper on the lower end of the tester was opened. The time required for all the detergent powder to fall down was measured, and the flowability was evaluated based on this time. A shorter time indicates a better flowability.

The breaking load was measured in the following manner. Namely, 1.5 g of the powdery detergent was charged in a cylindrical cylinder having a diameter 1.5 cm, and an iron plate having a weight of 100 g was placed thereon and the detergent was compressed for 3 minutes to form a tablet. Then, iron plates, each having a weight of 10 g, were gradually placed on the tablet at intervals of 30 seconds. When the tablet was broken, the number of the iron plates were counted. This test was conducted three times and an average value was calculated. The breaking load is expressed in terms of grams of the iron plates. A higher breaking load indicates a higher stickiness.

The caking property was determined in the following manner. Namely, 12.5 g of the sample was charged in a box formed of filter paper [7.4 cm × 4.4 cm × 2.8 cm (height)], and the surface of the sample was levelled and an iron plate of a size of 7.2 cm × 4.2 cm was placed on the sample. The sample was allowed to stand for 7 days in a thermostat chamber maintained at a temperature of 30° C. and a relative humidity of 80%. Then, the detergent powder was placed on a sieve of a mesh size of 4 mm × 4 mm. The weight A (g) of the powder left on the sieve and the weight B (g) passing through the sieve were measured and the passage ratio was calculated according to the formula:

$$\text{Passage ratio (\%)} = \frac{B}{A+B} \times 100$$

A higher value indicates a reduced tendency to cake.

Table 3

| Run No. | Amount (%)* of Adsorption Mixture | Flowability (seconds) | Bleaking Load (g) | Passage Ratio (%) |
|---|---|---|---|---|
| 18 | 0 | 8.8 | 148 | 65 |
| 19 | 5 | 8.6 | 132 | 70 |
| 20 | 10 | 8.7 | 121 | 72 |
| 21 | 15 | 8.5 | 140 | 71 |
| 22 | 20 | 8.8 | 145 | 68 |
| 23 | 25 | 8.5 | 139 | 69 |
| 24 | 30 | 8.4 | 148 | 70 |

Note: *amount of the adsorption mixture per 100 parts by weight of the powdery detergent.

From the results shown in Table 3, it will readily be understood that even when the non-ionic surface active agent adsorption mixture of the present invention is incorporated in a powdery detergent, the detergent retains a good flowability and the adsorption mixture has no bad influence on detergents and other powdery materials.

EXAMPLE 5

The washing power of a detergent comprising an adsorption mixture containing 20% by weight of adsorbed Softanol 70 (the product of Nippon Shokubai Kagaku described above) and having the following composition was tested.

Composition:

| | |
|---|---|
| Sodium linear-dodecyl benzene sulfonate | 20% by weight |
| Softanol 70 adsorption mixture (Table 4) | 20% by weight |
| Sodium tripolyphosphate | 5% by weight |
| Sodium silicate | 5% by weight |
| Sodium carbonate | 5% by weight |
| Fluorescent dye | 0.3% by weight |
| Water | 10% by weight |
| Sodium sulfate | balance |

(1) Washing Test:

(1-1) Preparation of Artificially Soiled Cloth

A cotton cloth of 10 cm × 10 cm was soiled with an oil having the following composition and a minute amount of carbon black.

| | |
|---|---|
| Cotton seed oil | 60% |
| Cholesterol | 10% |
| Oleic acid | 10% |
| Palmitic acid | 10% |
| Liquid and solid paraffins | 10% |

(1-2) Calculation of Washing Ratio

Reflectances of the original cloth and the soiled cloth before and after washing at 500 mμ were measured by an automatic recording colorimeter (manufactured by Shimazu Seisakusho), and the washing ratio (D %) was calculated according to the following formula:

$$D = \frac{L_2 - L_1}{L_0 - L_1} \times 100$$

wherein $L_0$ stands for the reflectance of the original cloth, $L_1$ stands for the reflectance of the soiled cloth before washing, and $L_2$ stands for the reflectance of the soiled cloth after washing.

(1-3) Washing Method

The washing was carried out by using a Terg-O-Tometer (100 rpm) under the following conditions:

| | |
|---|---|
| Bath ratio: | 1/60 |
| Water temperature: | 20° C. |
| Washing time: | 10 minutes |
| Rinsing: | 5 minutes with service water |
| Hardness of water: | 4° DH ($Ca^{2+}/Mg^{2+}$ = 3 moles/1 mole) |
| Detergent concentration: | 0.2% |

(2) Results:

Obtained results are as follows.

| Run No. | Adsorbent | Washing Ratio (%) |
|---|---|---|
| 25 | P-1* | 92 |
| 26 | P-2* | 88 |
| 27 | P-3* | 91 |
| 28 | P-4* | 94 |
| 29 | P-5* | 92 |
| 30 | finely divided silica(1) | 69 |

The embodiments of the invention in which an exclusive privilege or property is claimed are defined as follows:

1. A non-sticky dry powder consisting essentially of particles of water-insoluble, amorphous, phosphorus-containing alkali metal aluminosilicate having the formula $$X(M_2O).Al_2O_3.Y(SiO_2).Z(P_2O_5).\omega(H_2O)$$

wherein M is Na or K; X, Y and Z are mole numbers satisfying the relations $0.20 \leqq X \leqq 1.0$ $0.20 \leqq Y \leqq 4.00$ $0.001 \leqq Z \leqq 0.80$ and ω is zero or an optional positive number, said particles having adsorbed thereon water-soluble, synthetic, nonionic surface active agent, said powder containing from 1 to 75 wt. % of said nonionic surface active agent.

2. A non-sticky dry powder as claimed in claim 1 containing from 5 to 65 wt. % of said nonionic surface active agent.

3. A granular or powder detergent composition consisting essentially of from 5 to 75 wt. % of the non-sticky dry powder as claimed in claim 2, and the balance is other conventional ingredients of a water-soluble washing and cleaning detergent composition.

4. A non-sticky dry powder as claimed in claim 1 containing from 20 to 50 wt. % of said nonionic surface active agent.

5. A granular or powder detergent composition consisting essentially of from 10 to 50 wt. % of the non-sticky dry powder as claimed in claim 4, and the balance is other conventional ingredients of a water-soluble washing and cleaning detergent composition.

6. A non-sticky dry powder as claimed in claim 1 which has been prepared by mixing said nonionic surface active agent in liquid form with said particles.

7. A non-sticky dry powder as claimed in claim 1 in which said particles have a particle size smaller than 100μ.

8. A non-sticky dry powder as claimed in claim 1 in which said particles have a particle size smaller than 50μ.

9. A non-sticky dry powder as claimed in claim 1 in which said particles have a particle size smaller than 10μ.

10. A non-sticky dry powder as claimed in claim 1 in which said phosphorus-containing alkali metal aluminosilicate has a magnesium ion-sequestering capacity of at least 100 mg (calculated as $CaCO_3$) per gram of said aluminosilicate and a calcium ion-sequestering capacity of at least 100 mg (calculated as $CaCO_3$) per gram of said aluminosilicate.

11. A non-sticky dry powder as claimed in claim 1 in which said phosphorus-containing alkali metal aluminosilicate has a magnesium ion-sequestering capacity of at least 150 mg (calculated as $CaCO_3$) per gram of said aluminosilicate and a calcium ion-sequestering capacity of at least 150 mg (calculated as $CaCO_3$) per gram of said aluminosilicate.

12. A granular or powder detergent composition consisting essentially of from 1 to 100 wt. % of the non-sticky dry powder as claimed in claim 1, and the balance is other conventional ingredients of a water-soluble washing and cleaning detergent composition.

13. A granular or powdery detergent composition as claimed in claim 12, wherein said phosphorus-containing alkali metal aluminosilicate has a calcium ion-sequestering capacity of at least 100 mg, calculated as $CaCO_3$, per gram of said aluminosilicate and a magnesium ion-sequestering capacity of at least 100 mg, calculated as $CaCO_3$, per gram of said aluminosilicate.

14. A granular or powdery detergent composition as claimed in claim 12, wherein said phosphorus-containing alkali metal aluminosilicate has a particle size of less than 100 microns.

15. A granular or powdery detergent composition as claimed in claim 12, wherein said nonionic surface active agent is polyoxyethylene alkyl or alkenyl ether having an alkyl or alkenyl group having 10 to 20 carbon atoms on the average and containing 1 to 20 moles of added ethylene oxide.

16. A granular or powdery detergent composition as claimed in claim 12, wherein said nonionic surface active agent is polyoxyethylene alkyl phenyl ether having an alkyl group having 6 to 12 carbon atoms on the average and containing 1 to 20 moles of added ethylene oxide.

17. A granular or powdery detergent composition as claimed in claim 12, wherein said nonionic surface active agent is higher fatty acid alkanolamide or alkylene oxide adduct thereof, having the formula:

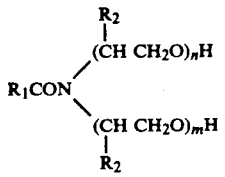

wherein $R_1$ is alkyl or alkenyl having 10 to 20 carbon atoms, $R_2$ is H or $CH_3$, n is an integer of from 1 to 3, and m is an integer of from 0 to 3.

18. A granular or powdery detergent composition as claimed in claim 12, wherein said nonionic surface active agent is sucrose fatty acid ester consisting of fatty acid having 10 to 20 carbon atoms on the average and sucrose.

19. A granular or powdery detergent composition as claimed in claim 12, wherein said nonionic surface active agent is fatty acid glycerin monoester consisting of fatty acid having 10 to 20 carbon atoms on the average and glycerin.

20. A granular or powdery detergent composition as claimed in claim 12, wherein said nonionic surface active agent is alkylamine oxide of the formula:

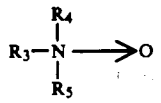

wherein $R_3$ is alkyl or alkenyl having 10 to 20 carbon atoms, and $R_4$ and $R_5$ each are alkyl having 1 to 3 carbon atoms.

21. A granular or powdery detergent composition as claimed in claim 12, wherein said other conventional ingredients comprise one or more water-soluble, synthetic, anionic surfactants, sodium tripolyphosphate, sodium sulfate and soda ash.

22. A granular powdery or detergent composition as claimed in claim 12, wherein said adsorption mixture further contains a disintegrating agent selected from the group consisting of starch, calcium carboxymethyl cellulose and alginic acid.

23. A granular or powdery detergent composition as claimed in claim 12 in which said other conventional ingredients comprise detergent builder, detergent alkaline agent, inorganic electrolyte for detergents, an anti-redeposition agent, a bleaching agent, a whitening agent, a perfume, an enzyme for detergents, a bluing agent or mixture thereof.

24. A granular or powdery detergent composition as claimed in claim 12, wherein Z of the formula (I) is in the range of from 0.01 to 0.55.

* * * * *

UNITED STATES PATENT AND TRADEMARK OFFICE

CERTIFICATE OF CORRECTION

PATENT NO. : 4 190 551

DATED : February 26, 1980

INVENTOR(S) : Moriyasu Murata et al

It is certified that error appears in the above-identified patent and that said Letters Patent are hereby corrected as shown below:

Column 10, line 8; change "1.0" to ---1.10---.

Signed and Sealed this

*Twenty-fourth* Day of *June 1980*

[SEAL]

*Attest:*

SIDNEY A. DIAMOND

*Attesting Officer*

*Commissioner of Patents and Trademarks*